US005167578A

United States Patent [19]

Legault

[11] Patent Number: 5,167,578

[45] Date of Patent: Dec. 1, 1992

[54] SOFFIT MOUNT AIR VENTILATOR

[76] Inventor: Reginald C. Legault, 1321 Pacquette Street, Sudbury, Ontario, P3A 5R7, Canada

[21] Appl. No.: 801,367

[22] Filed: Dec. 2, 1991

[51] Int. Cl.[5] ..... F24F 7/00

[52] U.S. Cl. ..... 454/350; 454/354

[58] Field of Search ..... 454/260, 341, 347, 349-354

[56] References Cited

U.S. PATENT DOCUMENTS

| | | | |
|---|---|---|---|
| 2,739,521 | 3/1956 | Spear | 454/350 X |
| 2,780,981 | 2/1957 | Miller . | |
| 2,785,622 | 3/1957 | Carrick . | |
| 2,790,377 | 4/1957 | Pyrne | 454/353 |
| 3,000,293 | 9/1961 | Grace . | |
| 4,498,373 | 2/1985 | Dittmer | 454/353 X |
| 4,667,581 | 5/1987 | Hovland | 454/260 |
| 4,872,398 | 10/1989 | Shen . | |

*Primary Examiner*—Robert G. Nilson
*Attorney, Agent, or Firm*—Stanley E. Johnson

[57] ABSTRACT

A vent hood mountable on the soffit of a building for exhausting a room ventilating system to atmosphere and a building having a room ventilating system connected to such soffit mounted vent. The ventilating system is a conventional power driven forced air unit with an air inlet communicating with the room to be ventilated and an exhaust outlet. The exhaust outlet is connected to the soffit mounted vent hood by a flexible conduit. The vent hood has a pivotally mounted flap valve normally closed and remains closed, when not in use, by the force of gravity. The flap valve is upstream from the discharge opening from the vent hood and preferably slopes, when in a closed position, relative to the vertical when the vent hood is mounted in situ.

14 Claims, 2 Drawing Sheets

SOFFIT MOUNT AIR VENTILATOR

FIELD OF INVENTION

The present invention relates to ventilating systems that draws air, smoke, vaporous material or other gases from an enclosure such as kitchens, bathrooms, laboratories, workshops and the like and forcibly discharges it to atmosphere and more particularly to such system wherein the discharge is through a vent mounted on the soffit of the building and to a vent hood adapted for mounting on the soffit.

BACKGROUND OF THE INVENTION

Bathrooms, washrooms and the like are presently ventilated using a blower or fan that is contained together with its driving motor within a housing that is set within a ceiling opening or a wall opening and which housing has an inlet communicating with the room to be ventilated and a discharge pipe or duct leading therefrom. In present residential dwellings the discharge from outlet is into the attic space above the living area. While this may be suitable in areas of mild climate, problems of condensation arises in areas subjected to cold atmospheric conditions during at least part of the year.

In cold climate areas the attic space is insulated from the living area with the insulation being adjacent the wall that separates the attic space from the living area. The attic space above the insulation is subjected to atmospheric conditions because of being ventilated through either roof vents or soffit vents or both permitting air to circulate therethrough. When operating the ventilating system during cold weather the hot air being discharged into the cold air space causes condensation that not only can cause rotting of the wood in due time from which the building is constructed but also it can reduce the insulative value of the insulation.

For the purpose of ventilating the attic space there is disclosed in U.S. Pat. No. 4,667,581, issued May 26, 1987, a soffit mounted ventilator that is wind responsive. The purpose of the patented structure is to allow ventilation of the attic space but automatically close upon a predetermined wind velocity so as to prevent introduction of wind blown snow, rain or other particulate matter into the attic space of the building.

SUMMARY OF INVENTION

A principal object of the present invention is to provide a vent for exhausting a room ventilating system to atmosphere through the soffit of a building.

In accordance with one aspect of the present invention there is particularly provided in a building having a room ventilating system comprising a power driven forced air unit with an air inlet communicating with the room to be ventilated and an exhaust outlet, the improvement comprising a vent hood mounted on the soffit of said building and conduit means connecting said exhaust outlet to said vent hood so as to discharge air from said power driven unit to atmosphere. The vent hood has a normally closed flap valve that prevents air from atmosphere entering the power driven unit when such unit is not in use but wherein the valve opens automatically by the flow of air when the power driven forced air unit is turned on.

In accordance with another aspect of the present invention there is provided a soffit mountable vent hood for a forced air room ventilating system comprising a housing having an air flow passage with an inlet and an outlet at respective opposite ends of said passage, flange means on said housing and located at a position between said inlet and outlet for mounting said housing on the soffit of the building, a flap valve in said passage having a normally closed position to prevent back flow of air through said passage and which opens automatically in response to air forced to flow through the passage in the direction from said inlet to said outlet. The inlet and the outlet of the vent hood are respectively above and below the soffit and the valve in the passage is preferably a simple flap valve hinged at its upper end to the housing so as to automatically close by gravity. In the preferred form the flap valve, in its closed position, is sloped relative to the vertical with the hinged upper end being closer to the inlet than the lower movable end of the flap valve. The housing defining the passageway may be circular, rectangular or square but when circular there are obviously limitations on the fit and movement of the valve.

LIST OF DRAWINGS

The invention is illustrated by way of example in the accompanying drawings wherein.

DESCRIPTION OF PREFERRED EMBODIMENTS

Figure 1:
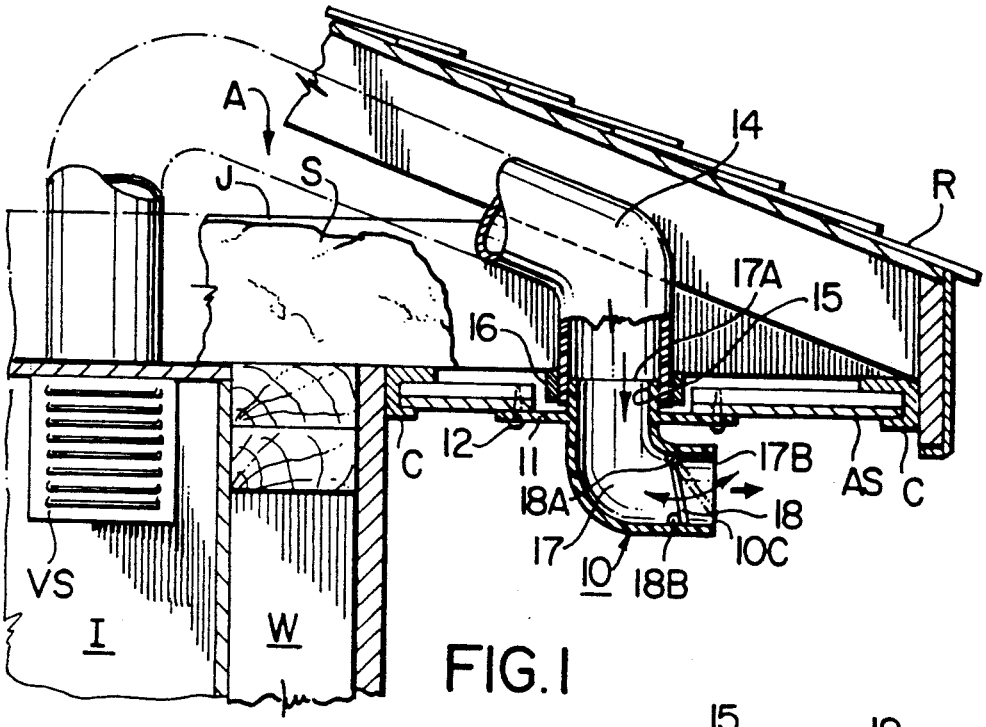
FIG. 1 is a partial sectional view of a portion of a room ventilating system of a building having a soffit mounted vent hood provided in accordance with the present invention.

Referring to FIG. 1 there is illustrated, in partial cross-sectional view, an exterior side wall W of a building having a roof R and an attic space A. The attic space A is insulated from the interior of the building I by batt or loose insulation S located between the ceiling joists J. The attic space A is vented to atmosphere in a conventional manner not shown through the use of roof ventilators and/or openings through the soffit. The building portion illustrated in FIG. 1 has a soffit clad with aluminum sheeting AS supported at opposite ends by aluminum channels C secured to the building.

In accordance with the present invention a room venting system discharges through a vent hood 10 attached by way of a bracket 11 and fastening means to the soffit of the building. The bracket 11 may be an integral part of the vent hood as illustrated in FIG. 1 or a separate bracket designated 11A in FIG. 2 attached to the vent hood by a mechanical fastener illustrated in the drawing or by an adhesive. The mechanical fastener may be in the form of pins, screws, bolts or the like and illustrated in FIG. 2 are two pins P that project into the wall of the housing of the vent hood.

Figure 2:
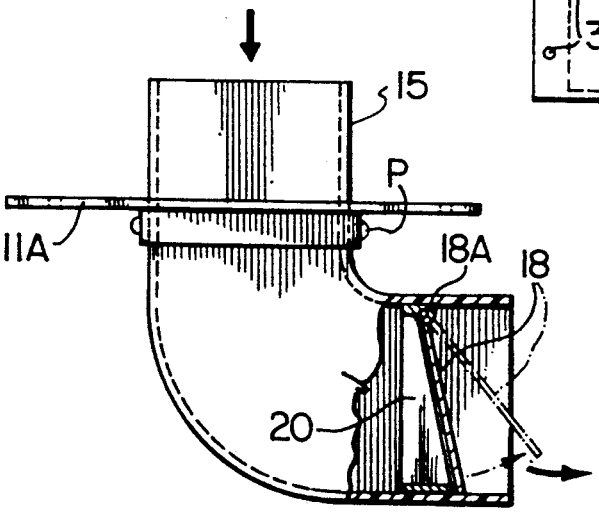
FIG. 2 is a vertical, partial sectional, elevational view of a vent hood similar to that illustrated in FIG. 1 but with minor modifications.

The housing of the vent hood in the embodiments illustrated in FIGS. 1 and 2 is an elbow of plastics material having a spigot 15 projecting above the mounting bracket and which connects to a conduit 14. The conduit 14 at the other end is attached to the exhaust outlet of the housing of a power driven room ventilator VS which is conventional and diagrammatically illustrated in FIG. 1.

The elbow illustrated in FIGS. 1 and 2 is a 90° elbow but it could be a 45° elbow and arranged so that the spigot end 15 slopes toward the attic space with the discharge end of the elbow still remaining horizontal. A 45° elbow reduces the amount of bend in some installations for the end portion of the conduit 14 that attaches to the spigot. The conduit 14 can merely be a friction fit on the spigot or securely anchored thereto by an adjustable clamp 16 which may be any well known hose clamp.

The vent housing 10 has a through passage 17 that has an inlet end 17A and an outlet or exhaust end 17B. The through passage 17, near the outlet end 17B, has a horizontally disposed portion in which there is located a flap valve 18. The flap valve is pivotally attached at its upper end to the housing as illustrated in FIG. 1 or to a sleeve as illustrated in FIG. 2 that is inserted in the housing. In the embodiment illustrated in FIG. 1 the flap valve, in its closed position, abuts a stop 18B in the through passage. The flap valve 18 is normally closed and is opened as a result of air being forced through the passage 17 from the inlet end 17A to the discharge end by the forced air room ventilating system. The flap valve 18, being suspended at the upper end, remains in a closed position by virtue of gravity.

In the embodiment illustrated in FIG. 2 the flap valve 18 is pivotally attached as an 18A to a short sleeve portion 20 that is force fit into the passage or attached for example by way of an adhesive or the like to the housing interiorly of the passage. In the embodiment illustrated in FIG. 2 the sleeve has a sloped end that the flap valve abuts against. This sloping valve relative to the vertical together with positioning of the pivot for the flap valve causes there to be some pressure on the valve to keep it in its closed position. The edge of the insert 20 in this embodiment provides a seat for the valve.

In each of the embodiments illustrated in FIGS. 1 and 2 the flap valve 18 is spaced upstream from the exhaust end of the passageway. This is done purposely so as to protect the valve from wind forces and thereby ensure the valve will not be caused to open by winds when the room ventilator is not in use.

The housing 10 illustrated in FIGS. 1 and 2, which is in the form of an elbow, may have an outer cross-sectional shape that is circular, rectangular or square.

Figure 3:
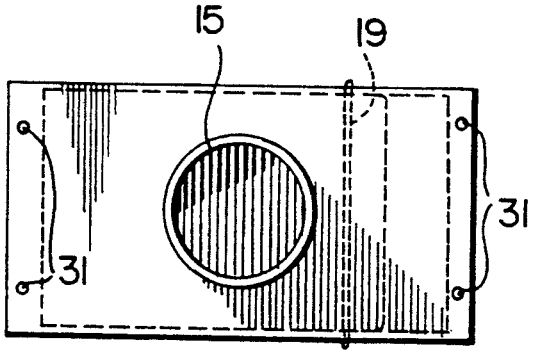
FIG. 3 is a top plan view of an alternative vent hood provided in accordance with the present invention.
Figure 4:
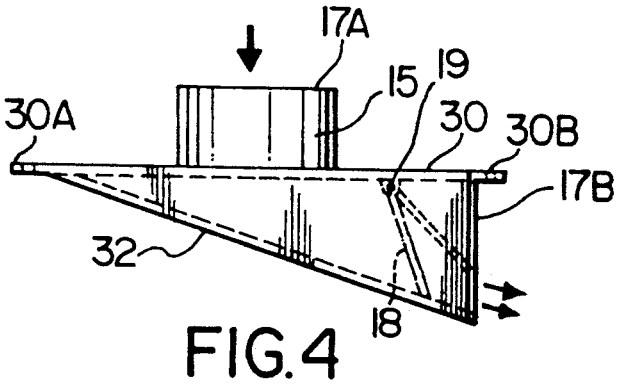
FIG. 4 is a side elevational view of the vent hood illustrated in FIG. 3.
Figure 5:
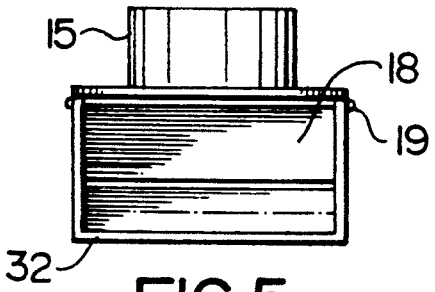
FIG. 5 is a right hand elevational view of FIG. 4.

Another embodiment of the soffit mountable vent hood provided in accordance with the present invention is illustrated in FIGS. 3, 4 and 5. This embodiment is similar to a vent hood of known construction for residential clothes dryers where the hood is mounted in a vertical wall. The present vent hood, however, differs from the known dryer vent by having the flap valve 18 pivoted at its upper end to the housing at a position downstream from the outlet of spigot 15 and closes the passage by having its lower free end engage the sloped wall of the hood. The valve in its closed position is sloped, as clearly seen from FIG. 4, relative to the vertical.

In the embodiment illustrated in FIGS. 3 to 5 the housing of the vent hood has an upper wall 30 with opposite end portions 30A and 30B provided with through holes 31 to receive sheet metal screws that fasten the vent hood to the soffit. A spigot 15 projects upwardly from the upper wall for attachment to the discharge hose 14 of the room ventilator.

The through passage 17, as in the other embodiments, has an inlet end 17A and an outlet end 17B with a flap valve 18 located in such passageway upstream of the discharge end 17B. The flap valve 18 has a shaft 19 (or stub shafts) projecting through an aperture in the respective opposite side walls of the housing providing a pivotal mounting for the valve. The bottom free end of the flap valve 18 abuts against the inner surface of the sloped bottom wall 32 of the through passage at a position further downstream than the pivotal mounting. In other words the pivot for the flap valve is further from the discharge end 17B than is the free bottom end of the valve that engages the passageway. This arrangement has the flap valve sloped providing some pressure on the valve merely by gravitational forces to keep it in its closed position.

Figure 6:
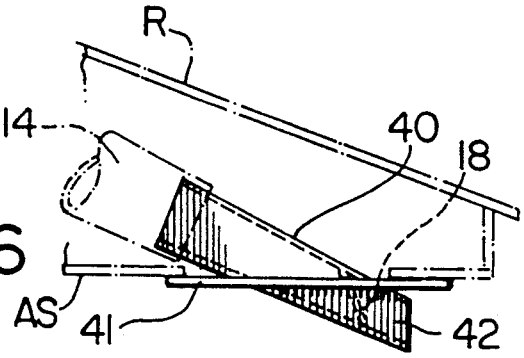
FIG. 6 is a view similar to FIG. 1 showing a modified soffit mounted vent hood provided in accordance with the present invention.

FIG. 6 illustrates a still further embodiment wherein the vent hood consists of a straight conduit portion 40 having a mounting flange or bracket 41 secured thereto intermediate the ends thereof and sloped relative to the axis of the conduit. The discharge end 42 of the conduit is preferably vertically disposed as illustrated in FIG. 6 but could, if desired, be disposed horizontally. FIG. 6 but could, if desired, be disposed horizontally. The conduit 40, as in the other embodiments, has a through passageway with a flap valve 18 pivotally mounted therein on its upper end and sloped as in the case previously described with respect to the embodiments illustrated in FIGS. 2 and 4. In the FIG. 6 embodiment the flap valve 18 is located upstream of the discharge end 42. The embodiment of FIG. 6 is useful where space is limited between the roof R and the top side of the soffit covering AS.

Figure 7:
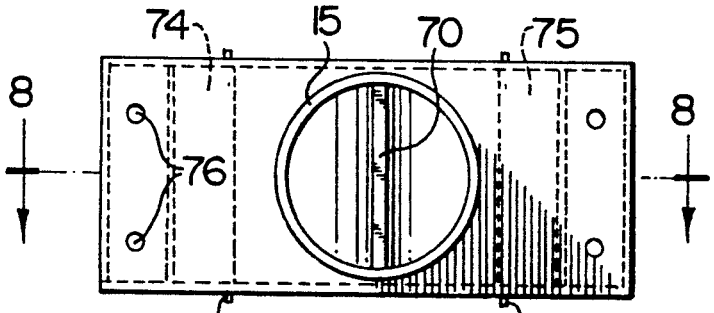
FIG. 7 is a top view of a still further embodiment of the soffit mountable vent hood.
Figure 8:
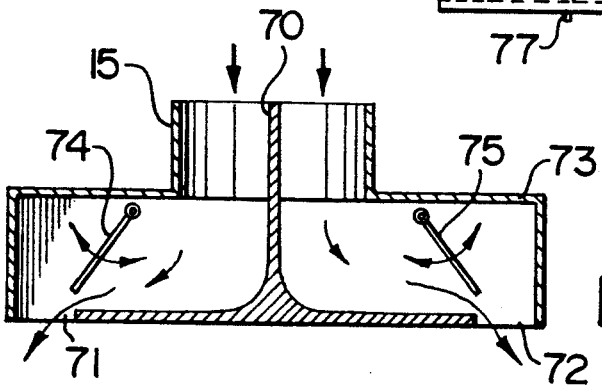
FIG. 8 is a sectional view along line 8—8 of FIG. 7.

A still further embodiment of the soffit mountable vent is illustrated in FIGS. 7 and 8. In this embodiment a baffle 70 divides the air flow to respective ones of two different outlets 71 and 72 from a housing 73. A pair of flap valves 74 and 75 closes the respective passageways to outlets 71 and 72. As in the previous embodiments flap valves 74 and 75 are preferably sloped relative to the vertical when in their closed position. The housing 73 is provided with apertures 76 for attaching the vent to the soffit of the building. As in the previous embodiments the housing is provided with an upwardly directed spigot 15 to which the conduit 14, illustrated in FIG. 1, attaches. The respective flap valves 74 and 75 are attached to the walls of the housing by respective shafts 77 and 78.

In all of the foregoing embodiments the mounting bracket or flange, that is attached to or forms part of the housing, is secured to the soffit by sheet metal screws providing a simple quick and convenient mounting and one which obscures the aperture provided for the spigot of the vent hood.

From the foregoing it will be seen there is provided a bathroom or the like room ventilator that uses a forced air discharge system having a vent hood mountable in the soffit. The discharge of air from the vent hood may be either in a horizontal or a vertically downward direction and in all embodiments a simple flap valve is located in the passageway and spaced upstream from the discharge opening. The flap valve being so located and sloped, i.e., biased closed, even in a closed position prevents back flow of air into the ventilated room when the ventilating system is not in use.

I claim:

1. A soffit mountable vent hood for a forced air room ventilating system comprising a housing having an air flow passage therethrough with an inlet and an outlet at respective opposite ends of said passage, flange means on said housing and located at a position between said inlet and outlet for mounting said housing on the soffit of a building, said inlet and outlet being respectively above and below the soffit when said vent is mounted on the soffit, a flap valve in said passage, means pivotally mounting said flap valve and suspending it from an upper end thereof so as to close by gravity preventing back flow of air through said passage and open automatically in response to air forced to flow through said passage in a direction from said inlet to said outlet.

2. A vent hood as defined in claim 1 wherein said mounting flange means and housing are integrally formed.

3. A vent hood as defined in claim 1 wherein said mounting flange is a separate component detachably secured to said housing.

4. A vent hood as defined in claim 1 wherein said flap valve, in its closed position, is sloped relative to the vertical with the hinged upper end being closer to the inlet than its lower movable end.

5. A vent hood as defined in claim 1 wherein said flap valve is hingedly attached to a short sleeve inserted into said flow through passage of the vent.

6. A vent hood as defined in claim 1 wherein said sleeve has a sloped end and wherein said sloped end provides a seat for said flap valve.

7. A vent hood as defined in claim 1 wherein said housing is an elbow made of plastics material.

8. A vent hood as defined in claim 4 wherein said housing comprises an upper wall having a spigot projecting upwardly therefrom, said upper wall being securable to the soffit of a building, a lower wall and a pair of side walls and wherein said lower wall diverges from said upper wall in a direction toward said outlet.

9. A vent hood as defined in claim 1 wherein said housing has two outlets spaced apart from one another and two flap valves, said flap valves preventing back flow of air for a respective one of said outlets.

10. A vent hood as defined in claim 9 including a baffle in said housing dividing said air flow passage into respective first and second passages that terminate at a respective one of said two outlets.

11. In a building having a room ventilating system comprising a power driven forced air unit with an air inlet communicating with the room to be ventilated and an exhaust outlet, the improvement comprising a vent hood mounted on the soffit of said building and conduit means connecting said exhaust outlet to said vent hood so as to discharge air from said power driven unit to atmosphere, said vent hood having an air flow inlet end connected to said conduit means, an outlet spaced downstream from said inlet and a normally closed flap valve between said inlet and said outlet at a position spaced upstream from said outlet that prevents air from atmosphere entering the power driven unit when such unit is not in use but wherein said valve opens automatically by the flow of air caused to flow by said power driven forced air unit through said vent hood.

12. A soffit mountable vent hood for a forced air room ventilating system comprising a housing having an air flow passage with an inlet and an outlet at respective opposite ends of said passage, flange means on said housing and located at a position between said inlet and outlet for mounting said housing on the soffit of the building, a flap valve in said passage having a normally closed position and which opens automatically in response to air forced to flow through the passage in the direction from said inlet to said outlet, said inlet and said outlet being respectively above and below said soffit, said valve being a simple flap valve hinged at its upper end to the housing so as to automatically close by gravity and in its closed position being sloped relative to the vertical with the hinged upper end being closer to the inlet than the lower movable end of the flap valve.

13. A soffit mountable vent hood comprising:

(a) a housing having an upper wall, a bottom wall and side walls together defining an enclosure, said upper wall being securable to the soffit of a building and in abutting relation therewith when secured whereby the housing depends downwardly from the soffit;

(b) a spigot on the said upper wall and projecting upwardly therefrom through the soffit for attaching thereto a conduit from a room forced air ventilating unit; said spigot providing an inlet to an air flow passage through said housing;

(c) an outlet in a wall of said housing from said air passage through the housing and (d) a flap valve in said air passageway and pivotally attached to said housing with the pivot being located near the upper wall, said flap valve having a free lower end movable toward and away from said bottom wall respectively to close and open said air flow passage and in the closed position prevent the back flow of air therethrough, said flap valve being spaced upstream from the outlet in the wall of the housing and sloped relative to the vertical when in a closed position.

14. A soffit mountable vent hood as defined in claim 12 wherein said bottom wall is parallel to said top wall and wherein there are two outlets in said bottom wall, said two outlets being at respective opposite ends of said bottom wall and including a baffle in said air flow passage dividing the flow of air and directing it to respective ones of said two outlets.

* * * * *